US009625217B2

(12) United States Patent
Kim et al.

(10) Patent No.: US 9,625,217 B2
(45) Date of Patent: Apr. 18, 2017

(54) HEAT EXCHANGER AND AIR CONDITIONER INCLUDING SAME

(71) Applicant: LG Electronics Inc., Seoul (KR)

(72) Inventors: Kakjoong Kim, Seoul (KR); Donghwi Kim, Seoul (KR); Yongcheol Sa, Seoul (KR); Junseong Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 842 days.

(21) Appl. No.: 13/742,866

(22) Filed: Jan. 16, 2013

(65) Prior Publication Data

US 2013/0192809 A1 Aug. 1, 2013

(30) Foreign Application Priority Data

Jan. 20, 2012 (KR) ..... 10-2012-0006965

(51) Int. Cl.
*F28D 7/06* (2006.01)
*F28F 1/00* (2006.01)
(Continued)

(52) U.S. Cl.
CPC ..... *F28F 1/00* (2013.01); *F25B 39/00* (2013.01); *F25B 39/028* (2013.01);
(Continued)

(58) Field of Classification Search
CPC .... F28F 1/00; F28F 27/02; F28F 9/013; F28F 9/02; F28D 7/06
(Continued)

(56) References Cited

U.S. PATENT DOCUMENTS 4,389,851 A * 6/1983 Chrostowski ..... F25B 13/00 62/155
4,535,838 A * 8/1985 Gray ..... F25B 39/00 165/134.1
(Continued)

FOREIGN PATENT DOCUMENTS

JP 2003 121019 * 4/2003 ..... F25B 13/00
JP 2003121019 A 4/2003
(Continued)

*Primary Examiner* — Len Tran
*Assistant Examiner* — Gustavo Hincapie Serna
(74) *Attorney, Agent, or Firm* — Dentons US LLP

(57) ABSTRACT

An air conditioner includes a compressor and a heat exchanger. The heat exchanger includes a first header pipe to have a refrigerant compressed by the compressor to flow therein, a heat exchange unit including a plurality of first refrigeration tubes and a plurality of second refrigeration tubes to thermally exchange the refrigerant with air, a plurality of first header branch pipes coupling the first header pipe with corresponding first refrigeration tubes in the heat exchange unit, a bypass pipe to have the refrigerant, thermally exchanged in the heat exchange unit, passing therethrough in the air cooling operation, and a second header pipe to have the refrigerant passing through the bypass pipe to flow therein. A plurality of second header branch pipes couples the second header pipe with corresponding second refrigeration tubes in the heat exchange unit, where at least two first refrigeration tubes have at least one second refrigeration tube therebetween.

15 Claims, 4 Drawing Sheets

(51) Int. Cl.

| | |
|---|---|
| ***F25B 39/00*** | (2006.01) |
| ***F25B 39/02*** | (2006.01) |
| ***F28F 9/02*** | (2006.01) |
| *F25B 13/00* | (2006.01) |

(52) U.S. Cl.
CPC ..... *F28F 9/0275* (2013.01); *F25B 13/00* (2013.01); *F28F 2250/06* (2013.01)

(58) Field of Classification Search
USPC ..... 165/176, 144, 103; 62/515, 524, 525, 62/526, 160
See application file for complete search history.

(56) References Cited

U.S. PATENT DOCUMENTS

| | | | | |
|---|---|---|---|---|
| 5,806,585 | A * | 9/1998 | Yoshida | B23K 1/0012 165/171 |
| 6,230,506 | B1 * | 5/2001 | Nishida et al. | 62/223 |
| 6,257,014 | B1 * | 7/2001 | Jao | 62/324.6 |
| 7,353,664 | B2 * | 4/2008 | Kim | F25B 13/00 62/176.3 |
| 2009/0019872 | A1 * | 1/2009 | Kotani et al. | 62/225 |
| 2009/0019884 | A1 * | 1/2009 | Sekine et al. | 62/515 |
| 2010/0051229 | A1 * | 3/2010 | Choi et al. | 165/64 |
| 2010/0095701 | A1 * | 4/2010 | Strunk et al. | 62/324.6 |
| 2010/0293980 | A1 * | 11/2010 | Shimaoka | F25B 39/028 62/259.1 |
| 2011/0138839 | A1 * | 6/2011 | Lee | F25B 13/00 62/324.5 |

FOREIGN PATENT DOCUMENTS

| | | | |
|---|---|---|---|
| JP | 2010-234945 | * 10/2010 | B61D 27/00 |
| JP | 2010 234945 | * 10/2010 | B60H 1/00907 |
| KR | 2010-0115001 | * 11/2010 | F28F 27/02 |
| WO | 2010008960 A2 | 1/2010 | |

* cited by examiner

HEAT EXCHANGER AND AIR CONDITIONER INCLUDING SAME

CROSS-REFERENCE TO RELATED APPLICATION

This application claims the benefit of Korean Application No. 10-2012-0006965, filed on Jan. 20, 2012 in the Korean Intellectual Property Office, the disclosure of which is incorporated herein by reference.

BACKGROUND

Field of the Disclosure

The present disclosure relates to an air conditioner including a heat exchanger and, more particularly, to a heat exchanger in which the passage of a refrigerant is alternated in a heat exchange unit.

Discussion of the Related Art

In general, an air conditioner is an apparatus configured to include a compressor, an outdoor heat exchanger, an expansion valve, and an indoor heat exchanger, to cool or heat the interior of a room using a refrigerating cycle. That is, the air conditioner may include a cooler for cooling the interior of a room and a heater for heating the interior of a room. The air conditioner may also be formed of a combination cooling and heating air conditioner for cooling or heating the interior of a room.

If the air conditioner is formed of the combination cooling and heating air conditioner, the air conditioner further includes a 4-way valve for changing the passage of a refrigerant, compressed by the compressor, depending on an air cooling operation or a heating operation. That is, in the air cooling operation, the refrigerant compressed by the compressor flows into the outdoor heat exchanger through the 4-way valve, and the outdoor heat exchanger functions as a condenser. Next, the refrigerant condensed by the outdoor heat exchanger is expanded by the expansion valve, and the expanded refrigerant flows into the indoor heat exchanger. In this case, the indoor heat exchanger functions as an evaporator. Next, the refrigerant evaporated by the indoor heat exchanger flows into the compressor through the 4-way valve.

Meanwhile, in the heating operation, the refrigerant compressed by the compressor flows in the indoor heat exchanger through the 4-way valve, and the indoor heat exchanger functions as a condenser. Next, the refrigerant condensed by the indoor heat exchanger is expanded by the expansion valve, and the expanded refrigerant flows into the outdoor heat exchanger. In this case, the outdoor heat exchanger functions as an evaporator. Next, the refrigerant evaporated by the outdoor heat exchanger flows into the compressor through the 4-way valve.

SUMMARY

One object is to provide a heat exchanger in which the passage of a refrigerant is alternated in a heat exchange unit.

Objects of the present invention are not limited to the above-mentioned objects, and other objects that have not been described above will be evident to those skilled in the art from the following description.

An air conditioner according to an embodiment of the present invention includes a compressor; and a heat exchanger, including a first header pipe to flow therein a refrigerant compressed by the compressor, a heat exchange unit coupled to the first header pipe and to thermally exchange the refrigerant with air, a bypass pipe to have the refrigerant, thermally exchanged in the heat exchange unit, to pass therethrough in an air cooling operation, a second header pipe coupled to the heat exchange unit and to have the refrigerant passing through the bypass pipe, to flow therein in the air cooling operation, a plurality of first header branch pipes to couple the first header pipe and the heat exchange unit, and a plurality of second header branch pipes to couple the second header pipe and the heat exchange unit, wherein at least one of second header branch pipe crosses at least one of the first header branch pipe.

Details of other embodiments are included in the detailed description and drawings.

BRIEF DESCRIPTION OF THE DRAWINGS

The above and other objects and features of the present disclosure will become apparent from the following description of some embodiments given in conjunction with the accompanying drawings, in which.

DETAILED DESCRIPTION OF THE EMBODIMENTS

Merits and characteristics of the present disclosure and methods for achieving them will become more apparent from the following embodiments taken in conjunction with the accompanying drawings. However, the present invention is not limited to the disclosed embodiments, but may be implemented in various ways. The embodiments are provided to complete the disclosure and to allow those having ordinary skill in the art to fully understand the principles of the present invention. The same reference numbers may be used throughout the drawings to refer to the same or like parts.

Hereinafter, embodiments of the present invention will be described in detail with reference to the accompanying drawings for describing an outdoor heat exchanger.

Figure 1:
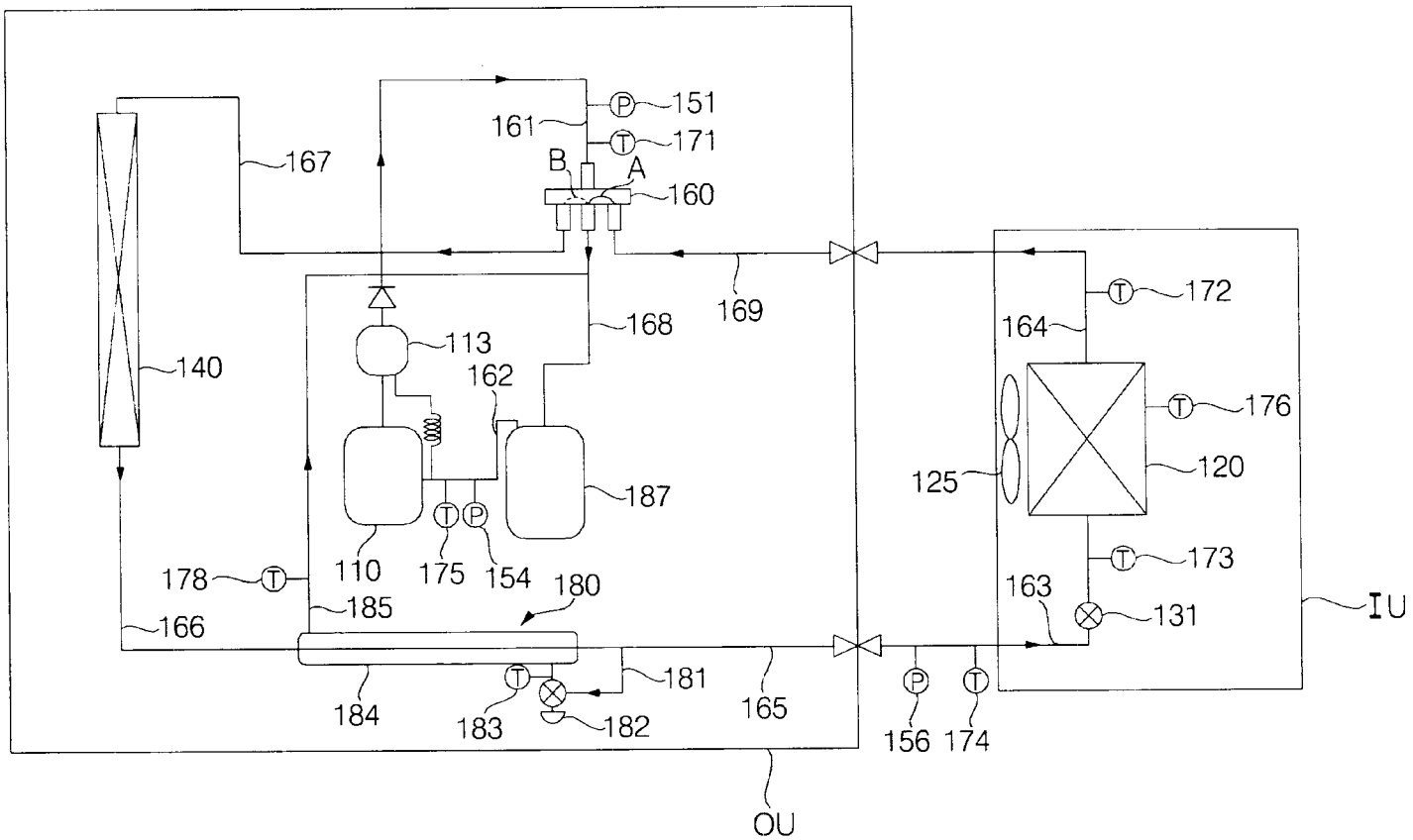
FIG. 1 shows a construction of an air conditioner according to an embodiment of the present invention.

FIG. 1 shows a construction of an air conditioner according to an embodiment of the present invention.

The air conditioner according to the embodiment of the present invention includes an outdoor unit OU and an indoor unit IU.

The outdoor unit OU includes a compressor 110, an outdoor heat exchanger 140, and a supercooler 180. The air conditioner may include one or a plurality of the outdoor units OU.

The compressor 110 compresses a refrigerant of a low temperature and low pressure into a refrigerant of a high temperature and high pressure. The compressor 110 may have various structures, and an inverter type compressor or a constant speed compressor may be adopted as the compressor 110. A discharge temperature sensor 171 and a discharge pressure sensor 151 are installed on the discharge pipe 161 of the compressor 110. Furthermore, a suction temperature sensor 175 and a suction pressure sensor 154 are installed on the suction pipe 162 of the compressor 110.

The outdoor unit OU is illustrated as including one compressor 110, but the present invention is not limited thereto. The outdoor unit OU may include a plurality of the compressors and may include both an inverter type compressor and a constant speed compressor.

An accumulator 187 may be installed in the suction pipe 162 of the compressor 110 in order to prevent a refrigerant of a liquid state from entering the compressor 110. An oil separator 113 for collecting oil from the refrigerant discharged from the compressor 110 may be installed in the discharge pipe 161 of the compressor 110.

A 4-way valve 160 is a passage switch valve for switching cooling and heating. The 4-way valve 160 guides the refrigerant compressed by the compressor 110 to the outdoor heat exchanger 140 in an air cooling operation and guides the compressed refrigerant to an indoor heat exchanger 120 in a heating operation. The 4-way valve 160 configures to state A in the air cooling operation and configures to state B in the heating operation.

The outdoor heat exchanger 140 is disposed in an outdoor space, and the refrigerant passing through the outdoor heat exchanger 140 is thermally exchanged with outdoor air at the outdoor heat exchanger 140. The outdoor heat exchanger 140 functions as a condenser in an air cooling operation and functions as an evaporator in a heating operation.

The outdoor heat exchanger 140 is coupled to a first inflow pipe 166 and then coupled to the indoor unit IU through a liquid pipe 165. The outdoor heat exchanger 140 is coupled to a second inflow pipe 167 and then coupled to the 4-way valve 160.

The supercooler 180 includes a supercooling heat exchanger 184, a second bypass pipe 181, a supercooling expansion valve 182, and a discharge pipe 185. The supercooling heat exchanger 184 is disposed on the first inflow pipe 166. In an air cooling operation, the second bypass pipe 181 functions to bypass the refrigerant discharged from the supercooling heat exchanger 184 so that the discharged refrigerant flows in the supercooling expansion valve 182.

The supercooling expansion valve 182 is disposed on the second bypass pipe 181. The supercooling expansion valve 182 lowers the pressure and temperature of a refrigerant by constricting the refrigerant of a liquid state that flows in the second bypass pipe 181 and then forces the refrigerant to flow in the supercooling heat exchanger 184. The supercooling expansion valve 182 may be various types, and a linear expansion valve may be used as the supercooling expansion valve 182 for convenience of use. A supercooling temperature sensor 183 for detecting temperature of the refrigerant constricted by the supercooling expansion valve 182 is installed on the second bypass pipe 181.

In an air cooling operation, a condensed refrigerant passing through the outdoor heat exchanger 140 is super-cooled through a thermal exchange with a refrigerant of low temperature, introduced through the second bypass pipe 181, in the supercooling heat exchanger 184, and the super-cooled refrigerant flows in the indoor unit IU.

The refrigerant passing through the second bypass pipe 181 is thermally exchanged in the supercooling heat exchanger 184, and the thermally exchanged refrigerant flows in the accumulator 187 through the discharge pipe 185. A discharge pipe temperature sensor 178 for detecting temperature of the refrigerant entering the accumulator 187 is installed on the discharge pipe 185.

A liquid pipe temperature sensor 174 and a liquid pipe pressure sensor 156 are installed on the liquid pipe 165 which couples the supercooler 180 and the indoor unit IU.

In the air conditioner according to the embodiment of the present invention, the indoor unit IU includes the indoor heat exchanger 120, an indoor fan 125, and an indoor expansion valve 131. The air conditioner may include one or a plurality of the indoor units IU.

The indoor heat exchanger 120 is disposed in an indoor space, and a refrigerant passing through the indoor heat exchanger 120 is thermally exchanged with indoor air at the indoor heat exchanger 120. The indoor heat exchanger 120 functions as an evaporator in an air cooling operation and functions as a condenser in a heating operation. An indoor temperature sensor 176 for detecting indoor temperature is installed at the indoor heat exchanger 120.

The indoor expansion valve 131 is an apparatus for constricting an inflow refrigerant in an air cooling operation. The indoor expansion valve 131 is installed in the indoor inlet pipe 163 of the indoor unit IU. The indoor expansion valve 131 may be various types, and a linear expansion valve may be used as the indoor expansion valve 131, for convenience of use. It is preferred that the indoor expansion valve 131 be opened in a set opening degree in an air cooling operation and be fully opened in a heating operation.

An indoor inlet pipe temperature sensor 173 is installed on the indoor inlet pipe 163. The indoor inlet pipe temperature sensor 173 may be installed between the indoor heat exchanger 120 and the indoor expansion valve 131. Furthermore, an indoor outlet pipe temperature sensor 172 is installed on the indoor outlet pipe 164.

In the air cooling operation of the above-described air conditioner, the flow of a refrigerant is described below.

A refrigerant of a high temperature and high pressure and a gaseous state, discharged from the compressor 110, flows into the outdoor heat exchanger 140 through the 4-way valve 160 and the second inflow pipe 167. The refrigerant is thermally exchanged with outdoor air at the outdoor heat exchanger 140, and thus condensed. The refrigerant discharged from the outdoor heat exchanger 140 flows into the supercooler 180 through the first inflow pipe 166. Next, the refrigerant is super-cooled by the supercooling heat exchanger 184, and the super-cooled refrigerant flows into the indoor unit IU.

A part of the refrigerant super-cooled by the supercooling heat exchanger 184 is constricted by the supercooling expansion valve 182, so that the refrigerant passing through the supercooling heat exchanger 184 is super-cooled. The refrigerant super-cooled by the supercooling heat exchanger 184 flows into the accumulator 187.

The refrigerant flowing into the indoor unit IU is constricted by the indoor expansion valve 131 opened in a set opening degree and is then thermally exchanged with indoor air at the indoor heat exchanger 120, thus being evaporated. The evaporated refrigerant flows into the compressor 110 through the 4-way valve 160 and the accumulator 187.

In the heating operation of the above-described air conditioner, the flow of a refrigerant is described below.

A refrigerant of a high temperature and high pressure and a gaseous state, discharged from the compressor 110, flows into the indoor unit IU through the 4-way valve 160. Here, the indoor expansion valves 131 of the indoor units IU are fully opened. The refrigerant discharged from the indoor unit IU flows into the outdoor heat exchanger 140 through the first inflow pipe 166. Next, the refrigerant is thermally exchanged with outdoor air at the outdoor heat exchanger 140, thus being evaporated. The evaporated refrigerant flows into the suction pipe 162 of the compressor 110 through the second inflow pipe 167, the 4-way valve 160, and the accumulator 187.

Figure 2A:
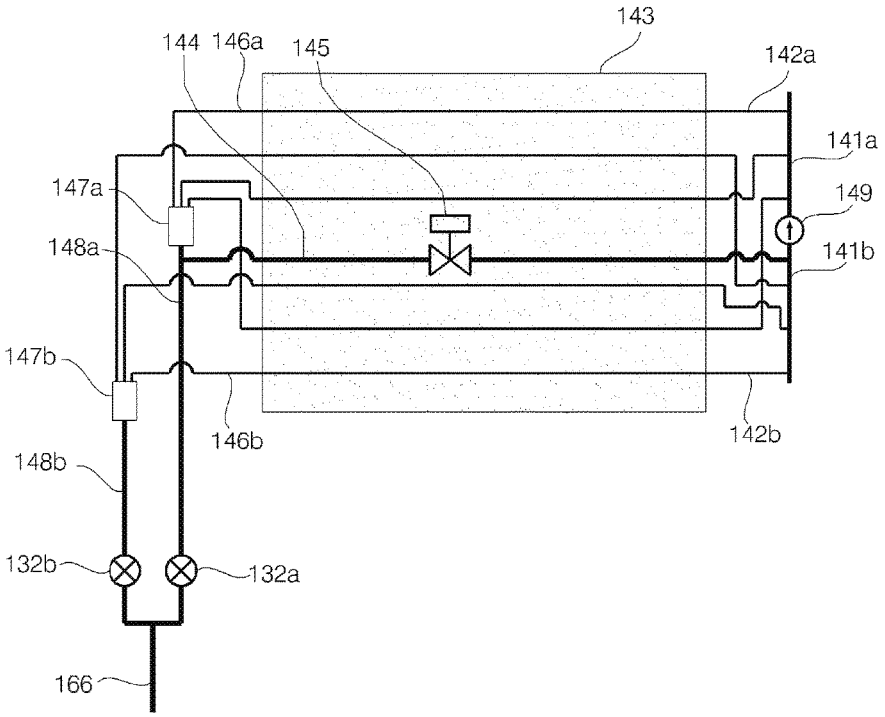
FIGS. 2A, 2B, and 3 show constructions of outdoor heat exchangers according to embodiments of the present invention.
Figure 2B:
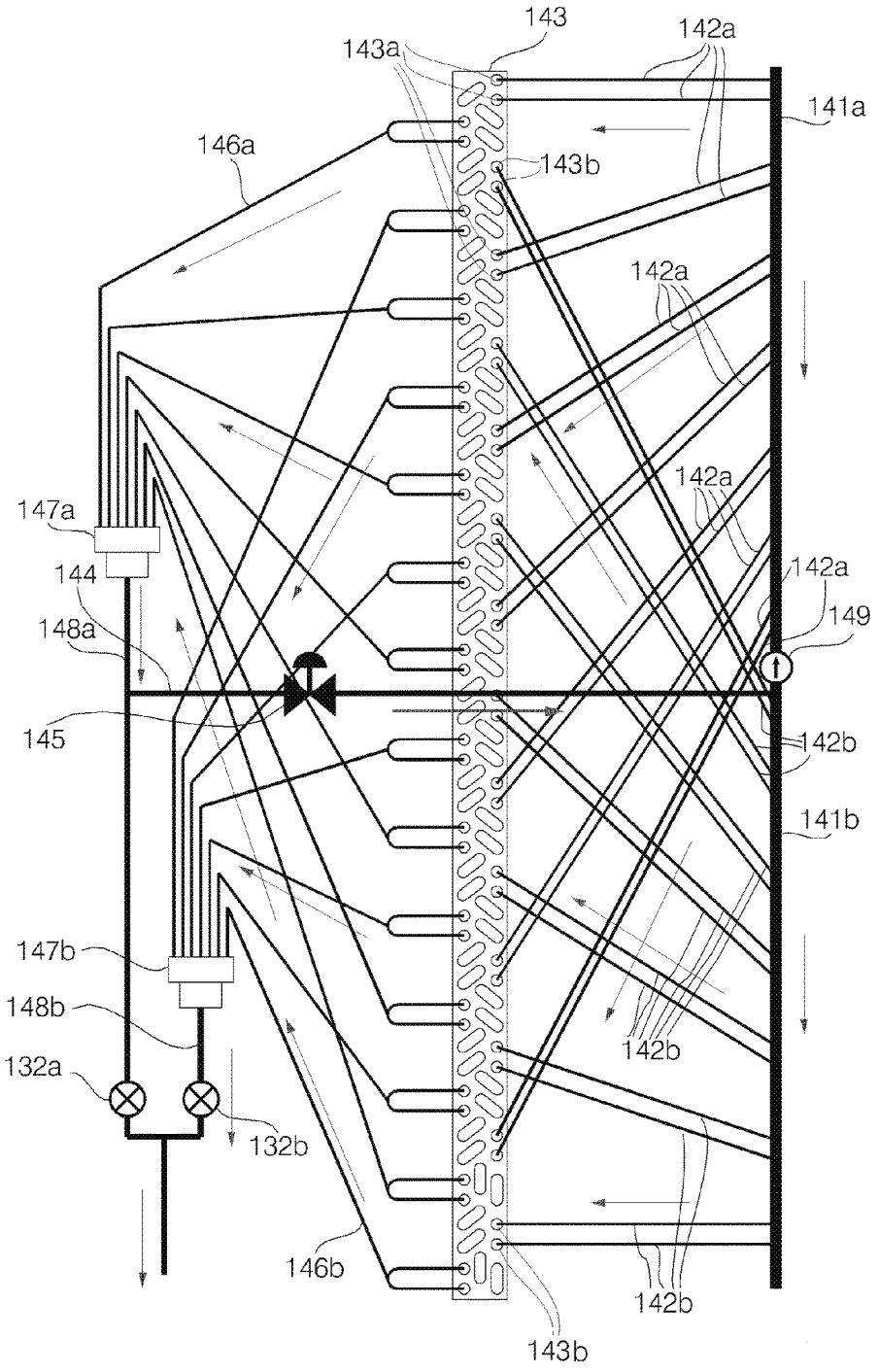
Figure 3:
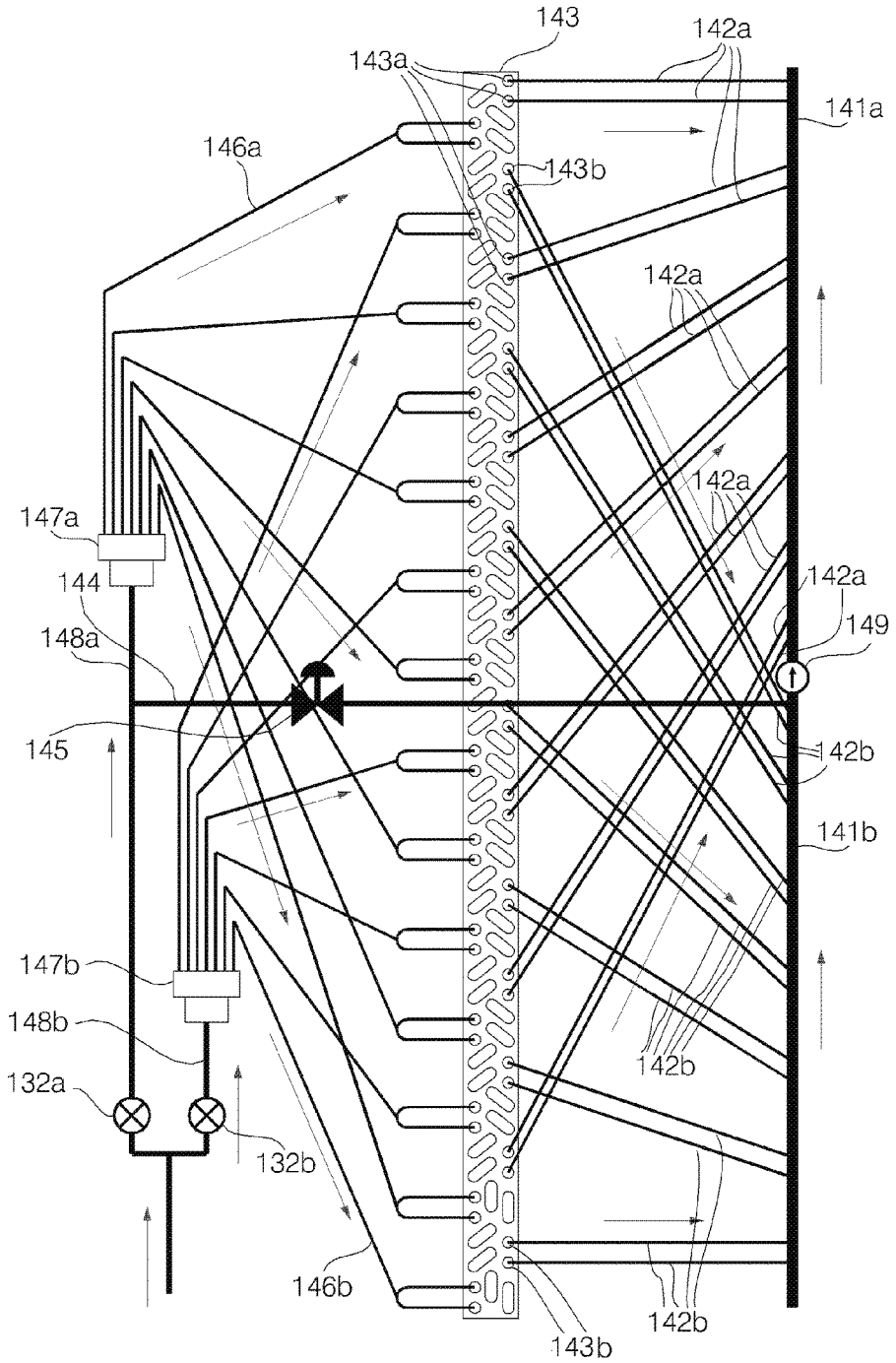

FIGS. 2A, 2B, and 3 show constructions of outdoor heat exchangers according to embodiments of the present invention. In FIG. 2A, the heat exchange unit 143 is shown in plan view, and in FIGS. 2B and 3, the heat exchange unit 143 is shown is cross-sectional view.

The outdoor heat exchanger 140 according to an embodiment of the present invention includes a first header pipe 141*a* configured to have a refrigerant, compressed by the compressor in an air cooling operation, to flow therein. A heat exchange unit 143 is coupled to the first header pipe 141*a* and is configured to thermally exchange a refrigerant with air. A bypass pipe 144 is configured to have the refrigerant, thermally exchanged in the heat exchange unit 143 in an air cooling operation, to pass therethrough. A second header pipe 141*b* is configured to have the refrigerant, passing through the bypass pipe 144, to flow therein in the air cooling operation and is coupled to the heat exchange unit 143. A plurality of first header branch pipes 142*a* is configured to couple the first header pipe 141*a* and the heat exchange unit 143, and a plurality of second header branch pipes 142*b* is configured to couple the second header pipe 141*b* and the heat exchange unit 143, and cross the plurality of first header branch pipes 142*a*.

The first header pipe 141*a* has one end coupled to the second inflow pipe 167, and thus is coupled to the compressor 110. The first header pipe 141*a* has the other end coupled to the bypass pipe 144 and the second header pipe 141*b*. A check valve 149 is disposed at the other end of the first header pipe 141*a*. The check valve 149 prevents a refrigerant from flowing from the first header pipe 141*a* to the second header pipe 141*b*, but allows a refrigerant to flow from the second header pipe 141*b* to the first header pipe 141*a*.

The first header pipe 141*a* is coupled to the plurality of first header branch pipes 142*a*. The first header pipe 141*a* is branched into the plurality of first header branch pipes 142*a* and is coupled to one end of the heat exchange unit 143.

The plurality of first header branch pipes 142*a* couples the first header pipe 141*a* and the heat exchange unit 143. The plurality of first header branch pipes 142*a* is branched from the first header pipe 141*a* and is coupled to the one end of the heat exchange unit 143. The plurality of first header branch pipes 142*a* is configured to cross the plurality of second header branch pipes 142*b* and is coupled to the one end of the heat exchange unit 143. In other words, the plurality of first header branch pipes 142*a* and the plurality of second header branch pipes 142*b* are alternately coupled to the heat exchange unit 143. The plurality of first header branch pipes 142*a* and the plurality of second header branch pipes 142*b* may be alternately coupled to the heat exchange unit 143 one by one or may be classified in groups of one or two or more and then alternately coupled to the heat exchange unit 143.

The plurality of first header branch pipes 142*a* and the plurality of second header branch pipes 142*b* are alternately coupled to one end of the heat exchange unit 143, and a plurality of first distribution branch pipes 146*a* and a plurality of second distribution branch pipes 146*b* are alternately coupled to the other end of the heat exchange unit 143. In this embodiment, the heat exchange unit 143 includes a plurality of refrigerant tubes 143*a* and 143*b* positioned parallel to each other through which a refrigerant flows and a plurality of electric heat pins. and thermally exchanges the refrigerant with air.

The plurality of first header branch pipes 142*a* and the plurality of second header branch pipes 142*b* are alternately coupled to respective refrigerant tubes such that at least two refrigerant tubes 143*a* coupled to the first header branch pipes 142*a* have at least one refrigerant tube 143*b* coupled to the second header branch pipe 142*b* therebetween. Or, the plurality of first header branch pipes 142*a* and the plurality of second header branch pipes 142*b* are alternately coupled to respective refrigerant tubes such that at least two refrigerant tubes 143*b* coupled to the second header branch pipes 142*b* have at least one refrigerant tube 143*a* coupled to the first header branch pipe 142*a* therebetween. Therebetween includes refrigerant tubes being immediately next to each other or there can be intervening refrigerant tubes.

Similarly, the plurality of first distribution branch pipes 146*a* and the plurality of second distribution branch pipes 146*b* are alternately coupled to respective refrigerant tubes such that at least two refrigerant tubes coupled to the first distribution branch pipes 146*a* have at least one refrigerant tube coupled to the second distribution branch pipe 146*b* therebetween. Or, the plurality of first distribution branch pipes 146*a* and the plurality of second distribution branch pipes 146*b* are alternately coupled to respective refrigerant tubes such that at least two refrigerant tubes coupled to the second distribution branch pipe 146*b* have at least one refrigerant tube coupled to the first distribution branch pipe 146*a* therebetween. Therebetween includes refrigerant tubes being immediately next to each other or there can be intervening refrigerant tubes.

The plurality of first header branch pipes 142*a* and the plurality of second header branch pipes 142*b* are alternately coupled to one ends of the plurality of refrigerant tubes of the heat exchange unit 143, and the plurality of first distribution branch pipes 146*a* and the plurality of second distribution branch pipes 146*b* are alternately coupled to the other end of the plurality of refrigerant tubes of the heat exchange unit 143. The refrigerant tube coupled to the first header branch pipe 142*a* is coupled to the first distribution branch pipe 146*a*, and the refrigerant tube coupled to the second header branch pipe 142*b* is coupled to the second distribution branch pipe 146*b*.

The plurality of first distribution branch pipes 146*a* couples a first distributor 147*a* and the heat exchange unit 143. The plurality of first distribution branch pipes 146*a* is merged into the first distributor 147*a*. The plurality of first distribution branch pipes 146*a* is coupled to the other end of the heat exchange unit 143 and is configured to cross the plurality of second distribution branch pipes 146*b*. In other words, the plurality of first distribution branch pipes 146*a* and the plurality of second distribution branch pipes 146*b* are alternately coupled to the heat exchange unit 143. The plurality of first distribution branch pipes 146*a* and the plurality of second distribution branch pipes 146*b* may be alternately coupled to the heat exchange unit 143 one by one or may be classified in groups of one or two or more and then alternately coupled to the heat exchange unit 143.

The first distributor 147*a* couples the plurality of first distribution branch pipes 146*a* and a first distribution pipe 148*a*. The plurality of first distribution branch pipes 146*a* is merged and coupled to the first distributor 147*a*. The first distributor 147*a* is coupled to the heat exchange unit 143 through the plurality of first distribution branch pipes 146*a*.

The first distribution pipe 148*a* is coupled to the first distributor 147*a*. The first distribution pipe 148*a* is coupled to the other end of the heat exchange unit 143 through the first distributor 147*a* and the plurality of first distribution branch pipes 146*a*.

The first distribution pipe 148*a* is coupled to the first inflow pipe 166. The first distribution pipe 148*a* and a second distribution pipe 148*b* are merged into the first inflow pipe 166.

A first expansion valve 132*a* for controlling the degree of opening of the first distribution pipe 148*a* is disposed in the first distribution pipe 148*a*. The first expansion valve 132*a* may constrict, bypass, or block a refrigerant passing through the first distribution pipe 148*a*.

The bypass pipe 144 has one end coupled to the first distribution pipe 148*a* and the other end coupled to the second header pipe 141*b*. An intermittent valve 145 is disposed in the bypass pipe 144 and is opened or closed in order to control the flow of a refrigerant. The intermittent valve 145 may be opened so that a refrigerant flows from the first distributor 147*a* to the second header pipe 141*b* and may be closed so that a refrigerant does not flow from the second header pipe 141*b* to the first distributor 147*a*.

In accordance with an embodiment, the bypass pipe 144 may be coupled to the first distributor 147*a* or may be coupled to the plurality of first header branch pipes 142*a*.

The second header pipe 141*b* is coupled to the bypass pipe 144 and the first header pipe 141*a*. The second header pipe 141*b* is coupled to the plurality of second header branch pipes 142*b*. The second header pipe 141*b* is branched into the plurality of second header branch pipes 142*b* and then coupled to one end of the heat exchange unit 143.

The plurality of second header branch pipes 142*b* couples the second header pipe 141*b* and the heat exchange unit 143. The plurality of second header branch pipes 142*b* is branched from the second header pipe 141*b* and then coupled to the one end of the heat exchange unit 143. The plurality of second header branch pipes 142*b* is coupled to the one end of the heat exchange unit 143 and is configured to cross the plurality of first header branch pipes 142*a*. That is, the plurality of second header branch pipes 142*b* and the plurality of first header branch pipes 142*a* are alternately coupled to the heat exchange unit 143. The plurality of second header branch pipes 142*b* and the plurality of first header branch pipes 142*a* may be alternately coupled to the heat exchange unit 143 one by one or may be classified in groups of one or two or more and then alternately coupled to the heat exchange unit 143.

The plurality of second distribution branch pipes 146*b* couples a second distributor 147*b* and the heat exchange unit 143. The plurality of second distribution branch pipes 146*b* is merged into the second distributor 147*b*. The plurality of second distribution branch pipes 146*b* is coupled to the other end of the heat exchange unit 143 and is configured to cross the plurality of first distribution branch pipes 146*a*. That is, the plurality of second distribution branch pipes 146*b* and the plurality of first distribution branch pipes 146*a* are alternately coupled to the heat exchange unit 143. The plurality of second distribution branch pipes 146*b* and the plurality of first distribution branch pipes 146*a* may be alternately coupled to the heat exchange unit 143 one by one or may be classified in groups of one or two or more and then alternately coupled to the heat exchange unit 143.

The second distributor 147*b* couples the plurality of second distribution branch pipes 146*b* and the second distribution pipe 148*b*. The plurality of second distribution branch pipes 146*b* is merged and coupled to the second distributor 147*b*. The second distributor 147*b* is coupled to the heat exchange unit 143 through the plurality of second distribution branch pipes 146*b*.

The second distribution pipe 148*b* is coupled to the second distributor 147*b*. The second distribution pipe 148*b* is coupled to the other end of the heat exchange unit 143 through the second distributor 147*b* and the plurality of second distribution branch pipes 146*b*.

The second distribution pipe 148*b* is coupled to the first inflow pipe 166. The second distribution pipe 148*b* and the first distribution pipe 148*a* are merged into the first inflow pipe 166.

A second expansion valve 132*b* for controlling the degree of opening of the second distribution pipe 148*b* is disposed in the second distribution pipe 148*b*. The second expansion valve 132*b* may constrict, bypass, or block a refrigerant passing through the second distribution pipe 148*b*.

The flow of a refrigerant in the air cooling operation of the above-described outdoor heat exchanger is described below with reference to FIG. 2.

A refrigerant compressed by the compressor 110 flows into the first header pipe 141*a* through the second inflow pipe 167. The check valve 149 prevents the refrigerant, flowing into the first header pipe 141*a*, from flowing into the second header pipe 141*b*. The refrigerant flowing into the first header pipe 141*a* flows into the heat exchange unit 143 through the plurality of first header branch pipes 142*a*.

The refrigerant flowing into the heat exchange unit 143 is thermally exchanged with air, thus being condensed. The refrigerant condensed by the heat exchange unit 143 flows into the plurality of first distribution branch pipes 146*a* and then flows into the first distribution pipe 148*a* via the first distributor 147*a*. In the air cooling operation, the first expansion valve 132*a* is closed. Thus, the refrigerant flowing into the first distribution pipe 148*a* does not flow into the first inflow pipe 166, but flows into the bypass pipe 144.

The refrigerant passing through the bypass pipe 144 flows into the second header pipe 141*b*. The refrigerant flowing into the second header pipe 141*b* flows into the heat exchange unit 143 through the plurality of second header branch pipes 142*b*.

The refrigerant flowing into the heat exchange unit 143 is condensed again through a thermal exchange with air. Here, since the plurality of second header branch pipes 142*b* and the plurality of first header branch pipes 142*a* are alternately coupled to the heat exchange unit 143, the refrigerants flowing from the plurality of second header branch pipes 142*b* to the heat exchange unit 143 flow between the refrigerants flowing from the plurality of first header branch pipes 142*a* to the heat exchange unit 143.

The refrigerant condensed by the heat exchange unit 143 flows into the plurality of second distribution branch pipes 146*b* and then flows into the second distribution pipe 148*b* via the second distributor 147*b*. In the air cooling operation, the second expansion valve 132*b* is fully opened. Thus, the refrigerant flowing into the second distribution pipe 148*b* flows into the first inflow pipe 166 and then flows into the indoor unit IU through the liquid pipe 165.

The flow of the refrigerant in the heating operation of the above-described outdoor heat exchanger is described below with reference to FIG. 3.

A refrigerant condensed by the indoor heat exchanger 120 of the indoor unit IU flows into the first inflow pipe 166 through the liquid pipe 165. The refrigerant flowing into the first inflow pipe 166 flows into the first distribution pipe 148*a* and the second distribution pipe 148*b*.

The refrigerant flowing into the second distribution pipe 148*b* is expanded by the second expansion valve 132*b* whose degree of opening is controlled. The refrigerant expanded by the second expansion valve 132*b* flows into the heat exchange unit 143 through the second distributor 147*b* and the plurality of second distribution branch pipes 146*b*.

The refrigerant flowed into the heat exchange unit 143 is thermally exchanged with air, thus being evaporated. The refrigerant evaporated by the heat exchange unit 143 flows into the second header pipe 141*b* via the second header branch pipe 142*b*.

In the heating operation, the intermittent valve 145 is closed, and thus the refrigerant flowing into the second header pipe 141*b* does not pass through the bypass pipe 144. The refrigerant flowing into the second header pipe 141*b* flows into the first header pipe 141*a*.

Meanwhile, the refrigerant flowing into the first distribution pipe 148*a* does not flow into the second header pipe 141*b* because the intermittent valve 145 is closed in the heating operation. Accordingly, the refrigerant flowing into the first distribution pipe 148*a* is expanded by the first expansion valve 132*a* whose degree of opening is controlled. The refrigerant expanded by the first expansion valve 132*a* flows into the plurality of first distribution branch pipes 146*a* via the first distributor 147*a*.

The refrigerant flowing into first distribution branch pipes 146*a* flows into the heat exchange unit 143. The refrigerant flowing into the heat exchange unit 143 is thermally exchanged with air, and thus evaporated.

The plurality of second distribution branch pipes 146*b* and the plurality of first distribution branch pipes 146*a* are alternately coupled to the heat exchange unit 143. Accordingly, the refrigerants flowing from the plurality of second distribution branch pipes 146*b* to the heat exchange unit 143 flow between the refrigerants flowing from the plurality of first distribution branch pipes 146*a* to the heat exchange unit 143.

The refrigerant evaporated by the heat exchange unit 143 flows into the first header pipe 141*a* through the plurality of first header branch pipes 142*a*. The refrigerant flowing into the first header pipe 141*a* is merged with the refrigerant passing through the second header pipe 141*b*. Next, the merged refrigerant flows into the second inflow pipe 167, and then into the compressor 110.

In the heating operation, the generation of frost is not concentrated on a part of the heat exchange unit 143 because the refrigerant passing through the plurality of first distribution branch pipes 146*a* from the heat exchange unit 143 and the refrigerant passing through the plurality of second distribution branch pipes 146*b* from the heat exchange unit 143 sequentially pass within the heat exchange unit 143.

Furthermore, in a defrosting operation for operating a cooling cycle in order to remove frost when the frost is generated, frost generated in the heat exchange unit 143 may be uniformly removed because the refrigerant passing through the plurality of first header branch pipes 142*a* from the heat exchange unit 143 and the refrigerant passing through the plurality of second header branch pipes 142*b* from the heat exchange unit 143 sequentially pass within the heat exchange unit 143.

The outdoor heat exchanger according to embodiments of the present invention has one or more of the following advantages.

First, there is an advantage in that the generation of frost is not concentrated on the variable heat exchanger in which condensation is performed twice in an air cooling operation because refrigerants flowing through different paths uniformly pass through the heat exchanger in a heating operation.

Second, there is an advantage in that frost may be uniformly removed because refrigerants flowing through different paths uniformly pass through the heat exchanger in a defrosting operation.

Effects of the embodiments of the present invention are not limited to the above-mentioned effects, and other effects that have not been described above will be evident to those skilled in the art from the following description.

The heat exchanger may be used in residential air conditioners, commercial air conditioners, and vehicles, such as cars and trucks. Vehicles such as electric cars and hybrid cars may take advantage of the air conditioners using the heat exchanger.

Furthermore, although the preferred embodiments of the present invention have been illustrated and described, the present invention is not limited to the above specific embodiments, and a person having ordinary skill in the art to which the invention belongs may modify the embodiments in various ways without departing from the gist of the claims. The modified embodiments should not be interpreted individually from the technical spirit or prospect of the present invention.

What is claimed is:

1. An air conditioner, comprising:

a compressor; and a heat exchanger, including:

a first header pipe to flow therein a refrigerant compressed by the compressor, a heat exchange unit, coupled to the first header pipe, to thermally exchange the refrigerant with air, a bypass pipe to have the refrigerant, thermally exchanged in the heat exchange unit, pass therethrough in an air cooling operation, a second header pipe, coupled to the heat exchange unit, to have the refrigerant passing through the bypass pipe to flow therein in the air cooling operation, a plurality of first header branch pipes to couple the first header pipe and the heat exchange unit, a plurality of second header branch pipes to couple the second header pipe and the heat exchange unit, wherein at least one of the plurality of second header branch pipes crosses at least one of the plurality of first header branch pipes, an intermittent valve, disposed in the bypass pipe, to open or close and thus control the flow of the refrigerant, a plurality of first distribution branch pipes, coupled to the heat exchange unit, to have the refrigerant, thermally exchanged in the heat exchange unit after the refrigerant passes through the first header pipe, to flow therein, a plurality of second distribution branch pipes, coupled to the heat exchange unit, to have the refrigerant, thermally exchanged in the heat exchanged unit after the refrigerant passes through the second header pipe, to flow therein, wherein at least one of the second distribution branch pipes crosses at least one of the first distribution branch pipes, wherein the heat exchange unit comprises a plurality of refrigerant tubes, and the plurality of first header branch pipes and the plurality of second header branch pipes are alternately coupled to a respective end of the plurality of refrigerant tubes, wherein the plurality of first distribution branch pipes and the plurality of second distribution branch pipes are alternately coupled to a respective another end of the plurality of refrigerant tubes, and wherein the first header pipe is coupled to the second header pipe and the heat exchanger, a first distribution pipe coupled to the bypass pipe, a first inflow pipe, and the plurality of first distribution branch pipes, a second distribution pipe coupled to the plurality of second distribution branch pipes, and a check valve, disposed in the first header pipe or the second header pipe, to prevent the refrigerant from flowing from the first header pipe to the second header pipe, wherein a downstream end of the first header pipe is coupled to an upstream end of the second header pipe, wherein an upstream end of the first header pipe is coupled to the compressor, wherein a first junction point connects a downstream end of the bypass pipe, the downstream end of the first header pipe, and the upstream end of the second header pipe, and wherein an upstream end of the bypass pipe is coupled to the first distribution pipe.

2. The air conditioner of claim 1, wherein the plurality of first header branch pipes and the plurality of second header branch pipes are alternately coupled to the respective end of the plurality of refrigerant tubes one by one.

3. The air conditioner of claim 1, wherein the plurality of first header branch pipes and the plurality of second header branch pipes are alternately coupled to the respective end of the plurality of refrigerant tubes in groups of one or more.

4. The air conditioner of claim 2, further comprising:

a first expansion valve, disposed in the first distribution pipe, to control a degree of opening of the first distribution pipe; and a second expansion valve, disposed in the second distribution pipe, to control a degree of opening of the second distribution pipe.

5. The air conditioner of claim 4, wherein the bypass valve is opened in the air cooling operation.

6. The air conditioner of claim 2, wherein the plurality of first distribution branch pipes and the plurality of second distribution branch pipes are alternately coupled to the respective another end of the plurality of refrigerant tubes one by one.

7. The air conditioner of claim 2, wherein the plurality of first distribution branch pipes and the plurality of second distribution branch pipes are alternately coupled to the respective another end of the plurality of refrigerant tubes in groups of one or more.

8. The air conditioner of claim 5, wherein the heat exchanger further comprises:

a first distributor into which the plurality of first distribution branch pipes is merged, a second distributor into which the plurality of second distribution branch pipes is merged, a first expansion valve, disposed in the first distribution pipe, to control a degree of opening, and a second expansion valve, disposed in the second distribution pipe, to control a degree of opening, wherein the first distribution pipe is coupled to the first distributor, wherein the second distribution pipe is coupled to the second distributor, wherein the first expansion valve is closed in the air cooling operation and the second expansion valve is opened in the air cooling operation.

9. The air conditioner of claim 8, wherein the first distributor is coupled to the bypass pipe.

10. An air conditioner comprising:

a compressor; and a heat exchanger including:

a first header pipe to have a refrigerant compressed by the compressor flow therein, a heat exchange unit, including a plurality of first refrigeration tubes and a plurality of second refrigeration tubes, to thermally exchange the refrigerant with air, a plurality of first header branch pipes coupling the first header pipe with corresponding first refrigeration tubes in the heat exchange unit, a bypass pipe to have the refrigerant, thermally exchanged in the heat exchange unit, passing therethrough in the air cooling operation, a second header pipe to have the refrigerant passing through the bypass pipe to flow therein, a plurality of second header branch pipes coupling the second header pipe with corresponding second refrigeration tubes in the heat exchange unit, wherein at least two first refrigeration tubes have at least one second refrigeration tube therebetween, an intermittent valve, disposed in the bypass pipe, to open or close and thus control the flow of the refrigerant, a plurality of first distribution branch pipes, coupled to the heat exchange unit, to have the refrigerant, thermally exchanged in the heat exchange unit after the refrigerant passes through the first header pipe, to flow therein, a plurality of second distribution branch pipes, coupled to the heat exchange unit, to have the refrigerant, thermally exchanged in the heat exchange unit after the refrigerant passes through the second header pipe in the air cooling operation, to flow therein, wherein the plurality of first distribution branch pipes and the plurality of second distribution branch pipes are alternately coupled to a respective another end of the plurality of first and second refrigerant tubes, and wherein the first header pipe is coupled to the second header pipe and the heat exchanger, a first distribution pipe coupled to the bypass pipe, a first inflow pipe, and the plurality of first distribution branch pipes, a second distribution pipe coupled to the plurality of second distribution branch pipes, and a check valve, disposed in the first header pipe or the second header pipe, to prevent the refrigerant from flowing from the first header pipe to the second header pipe, wherein a downstream end of the first header pipe is coupled to an upstream end of the second header pipe, wherein an upstream end of the first header pipe is coupled to the compressor, wherein a first junction point connects a downstream end of the bypass pipe, the downstream end of the first header pipe, and the upstream end of the second header pipe, and wherein an upstream end of the bypass pipe is coupled to the first distribution pipe.

11. The air conditioner of claim 10, wherein the plurality of first header branch pipes and the plurality of second header branch pipes are alternately coupled to a respective end of the plurality of first and second refrigerant tubes.

12. The air conditioner of claim 11, wherein the plurality of first header branch pipes and the plurality of second header branch pipes are alternately coupled to a respective end of the plurality of first and second refrigeration tubes one by one.

13. The air conditioner of claim 11, wherein the plurality of first header branch pipes and the plurality of second header branch pipes are alternately coupled to a respective end of the plurality of first and second refrigerant tubes in groups of one or more.

14. The air conditioner of claim 13, wherein the plurality of first distribution branch pipes and the plurality of second distribution branch pipes are alternately coupled to a respective another end of the plurality of first and second refrigerant tubes one by one.

15. The air conditioner of claim 13, wherein the plurality of first distribution branch pipes and the plurality of second distribution branch pipes are alternately coupled to a respective another end of the plurality of first and second refrigerant tubes in groups of one or more.

* * * * *